US005853299A

United States Patent [19]

Wu

[11] Patent Number: 5,853,299

[45] Date of Patent: Dec. 29, 1998

[54] LAMP SOCKET UNIT

[76] Inventor: Jeng-Shyong Wu, No. 14, Alley 1, Lane 326, Shyr-Piin Road, Hsin-Chu City, Taiwan

[21] Appl. No.: 721,246

[22] Filed: Sep. 26, 1996

[51] Int. Cl.[6] ..... H01R 4/24

[52] U.S. Cl. ..... 439/419; 439/619

[58] Field of Search ..... 439/419, 414, 439/280, 273, 274, 356, 360, 375, 340, 658, 659, 619, 667, 666, 699.2

[56] References Cited

U.S. PATENT DOCUMENTS

| | | | |
|---|---|---|---|
| 745,173 | 11/1903 | Fielding | 439/659 |
| 3,148,009 | 9/1964 | Abramson | 439/414 |
| 5,121,310 | 6/1992 | Ahroni | 439/419 |
| 5,573,419 | 11/1996 | Chen | 439/419 |
| 5,643,006 | 7/1997 | Wang et al. | 439/280 |
| 5,660,561 | 8/1997 | Tseng | 439/419 |
| 5,709,566 | 1/1998 | Tsuje et al. | 439/419 |

*Primary Examiner*—Gary F. Paumen
*Assistant Examiner*—Tho D. Ta
*Attorney, Agent, or Firm*—McGlew and Tuttle

[57] ABSTRACT

A lamp socket unit including an insulating body, several insulating wires, a bottom cover, several copper contact sheets and a lamp bulb. One end of the insulating body has an opening to receive the lamp bulb. Another end of the body is combined with a bottom cover having a wire slot, a copper contact sheet insertion hole and a bottom cover passing hole. The bottom cover has a stay with a reversed hook. One end of copper contact sheet has a taper portion and the another end has a contact portion. The copper contact sheet is arranged and fixed in the insertion hole. The taper portion is fixed in the wire slot, and the contact portion extended to the opening of the body of the lamp bulb. The insulating wire is placed within the wire slot of the body. The taper portion is pierced into the insulating cover of wire and contacted with several copper wires within the wire. The bottom cover presses the wire into the wire slot and the reversed hook fixes the bottom cover on the body. When the lamp bulb is put into the opening of the body, the copper contacted portion is contacted with the conducting wire or the head of lamp bulb so as to form an electric circuit. The rectangular copper contact sheet, has a cross-section in part formed to become elliptical or rectangular shape and has several taper portions. Both ends of the insulating body have a flange, or plug configuration to strengthen the connection of electric circuit and fill a gap when combined.

20 Claims, 9 Drawing Sheets

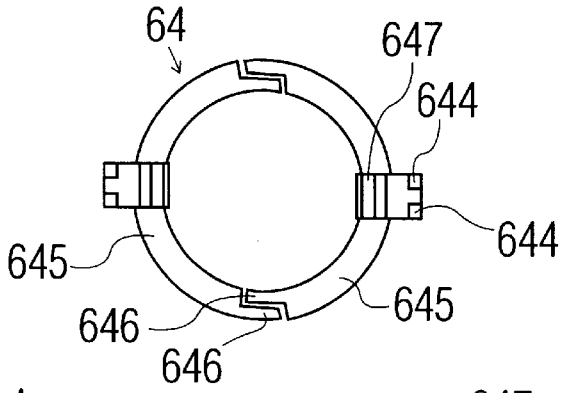
Figure 2B
Figure 2A
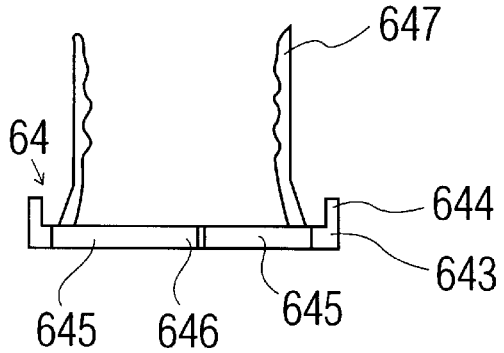
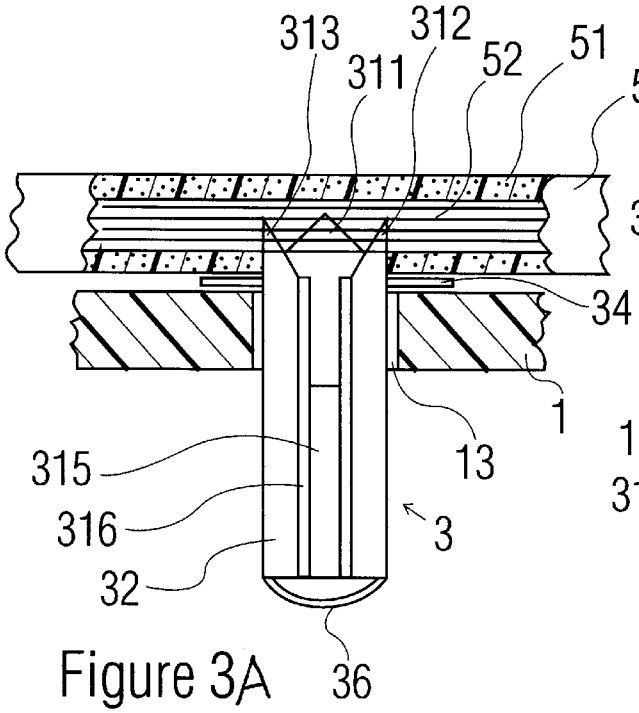
Figure 3A
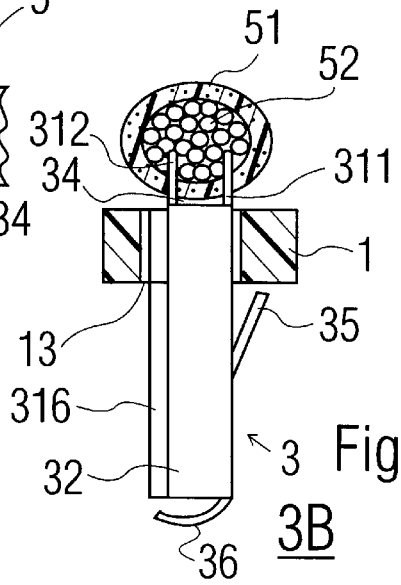
Figure 3B

LAMP SOCKET UNIT

BACKGROUND OF THE INVENTION

The present invention is generally relating to a lamp socket unit in a Christmas lighting string and more particularly to the combination structure of the lamp bulbs connected in series or parallel whereby to form a lighting string used as a kind of decoration. In general, the structure consists of a main body, a bottom cover, a copper sheet, a wire and a lamp bulb. The connection of the copper sheet to the wire is the taper on formed by a copper sheet to pierce into wire under the longitudinal direction. Such a connection can easily damage or cut off the copper wire so as to cause poor contact and danger. Further, after the combination of the assemblies, the gap between each assembly will be large so that the danger of electric shock is easily present.

The present invention answers the request of safety in electric appliances. The structure of the copper sheet and the contact method of wire is changed so as; not to cause the danger of electric shock and leakage, and improve the lamp socket unit to obtain a novel and safe device.

BRIEF DESCRIPTION OF THE DRAWINGS

FIG. 1 is a cross-section view of part of the lamp socket unit of the present invention.

FIG. 2 is the structure of plug configuration of the lamp socket unit of the present invention; FIG. 2A is the front view; FIG. 2B is the top view;

FIG. 3 is the copper contact sheet of the lamp socket unit, including a the combination of a wire and an insulating body; FIG. 3A is the cross-section of a front view; FIG. 3B is the cross-section of a side view;

FIG. 6 is the structure of a combination of the insulating body, the copper contact sheet and the bottom cover of the lamp socket unit.

FIG. 11 is a further embodiment of the cross-sectional side view of of the lamp socket unit.

DESCRIPTION OF PREFERRED EMBODIMENTS

Figure 1B:
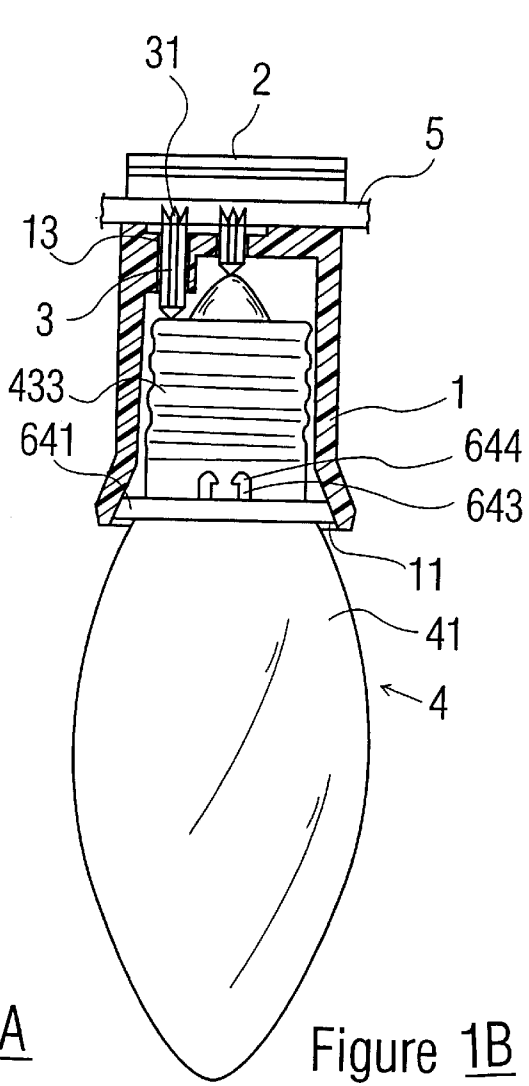
FIG. 1B is a cross-section of a side view.

The present invention relates to a structure of lamp socket unit and consists of an insulating body, several insulating wires, bottom or base cover, several copper contact sheets and lamp bulb. One end of the insulating body has a lamp opening to receive the lamp bulb, another end in combination with the bottom cover has a wire slot, a copper contact sheet passing hole and a bottom cover passing hole. The bottom or base cover has a base connection means which includes, stay with reversed hook, one end of copper contact sheet has a taper portion and the another end has a contact portion. The insulating portion of wire includes several copper wires. The copper contact sheet is arranged and fixed in the insertion hole for copper sheet of the main body, the taper portion of copper sheet being fixed in the wire slot contact portion is extended to the opening of the body of lamp bulb, and the insulating wire placed within the wire slot of the body. The taper portion is pierced into the insulating cover of wire and contacted with several copper wires within the wire. The bottom cover presses the wire within the wire slot tightly, and then the reversed hook fixes the bottom cover to on the body. When the lamp bulb is put into the lamp opening of the body, the copper contacted portion is contacted with the conducting wire or the head of lamp bulb so as to form an electric circuit. The design is to use a rectangular copper contact sheet, which is formed into a cross-section has in part or an elliptical shape or a rectangular shape and has several taper portions. Both ends of the insulating body have a flange, or plug configuration whereby to strengthen the connection of the electric circuit and to fill filling the gap when combined.

Figure 1A:
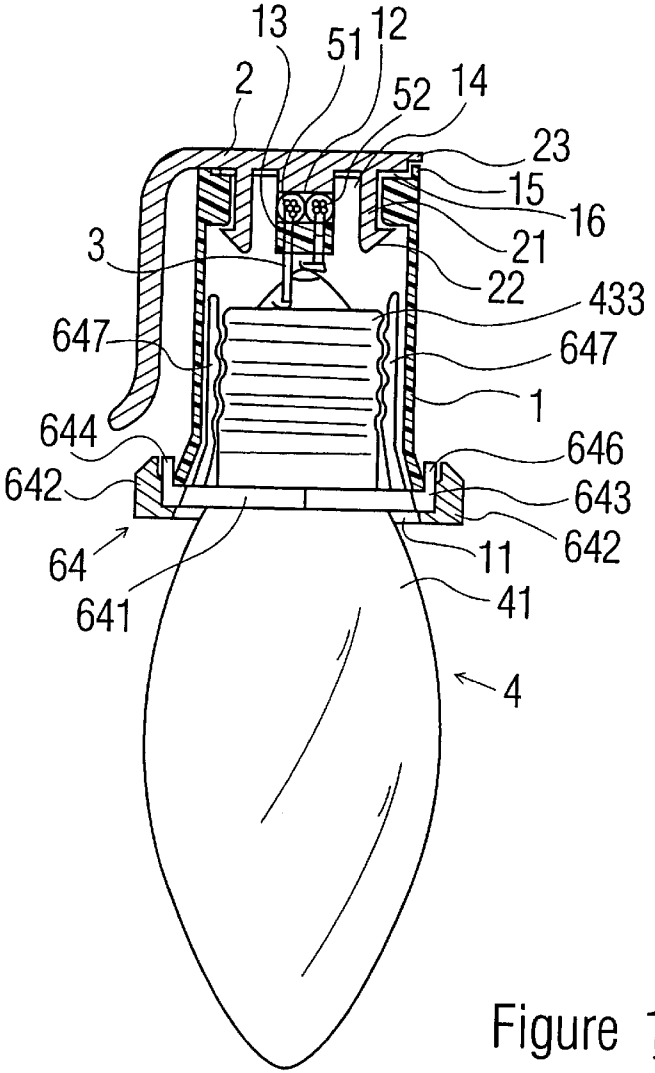
FIG. 1A is a cross-section of a front view.
Figure 4C:
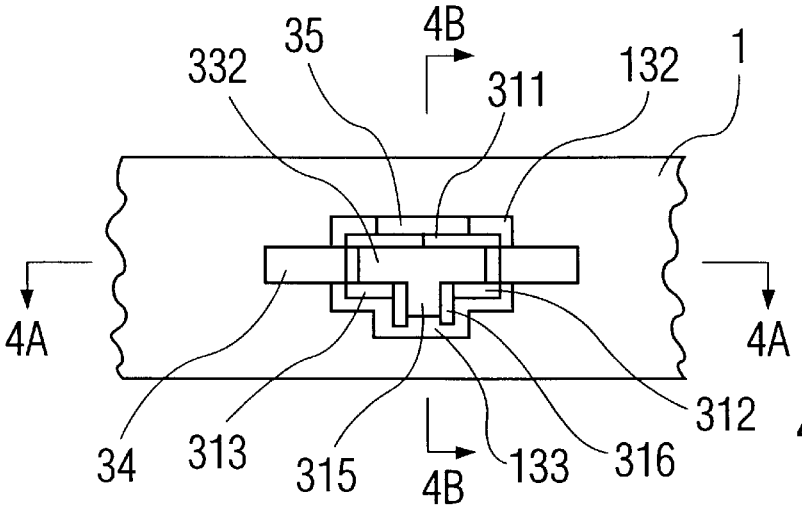
FIG. 4 is a view of the copper contact sheet and the insulating body of the lamp socket unit.
FIG. 4A is the cross-section of front line 4A—4A in FIG. 4C.
FIG. 4B is the cross-section of line 4B—4B in FIG. 4C; 4C is the top view.
FIG. 4D is the cross-section of line 4D—4D in FIG. 4A; line.
Figure 4D:
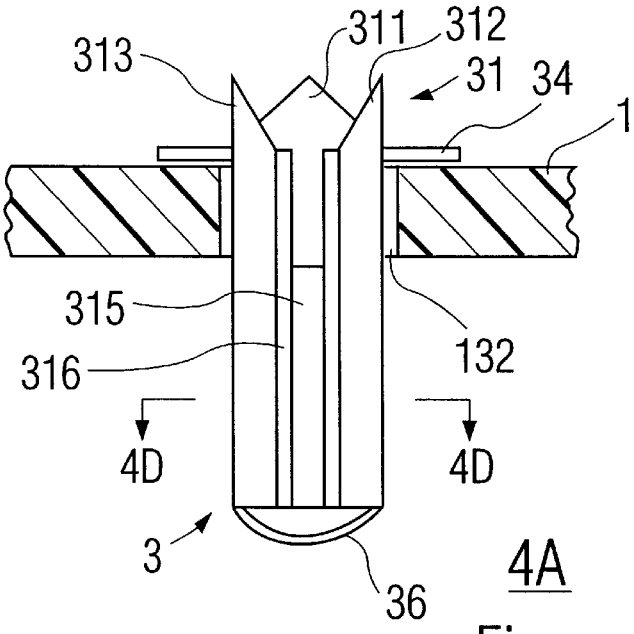
Figure 4D:
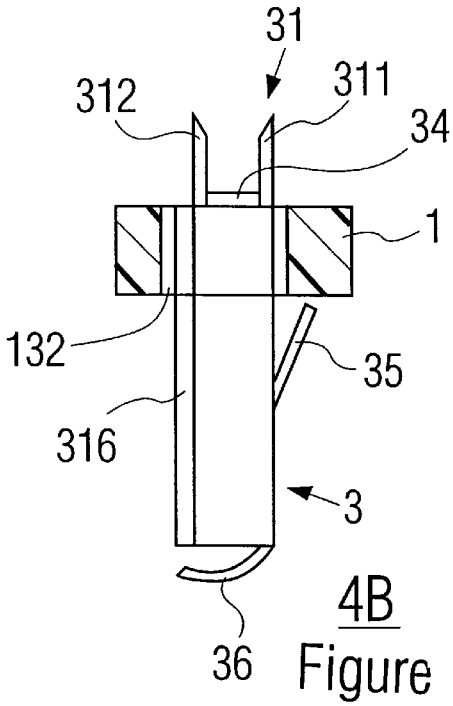
Figure 4D:
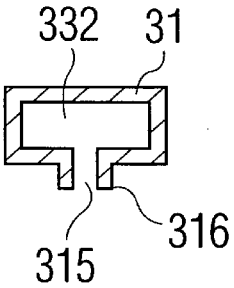

The present invention provides for different combinations on the basis of different assemblies. Each combination is suitable to a different usage, place and effect to obtain the desired safety. In order to understand the present invention completely, the descriptions are done for the preferred embodiments shown in the drawings:

Now referring to FIGS. 1, 1A and 1B, these drawings show the structure and combination of the assemblies of the lamp socket unit of the present invention. The lamp socket unit comprises insulating body 1, bottom or base cover 2, copper contact sheet 3, lamp bulb 4 and electric wire 5. One end of the insulating body 1 has lamp opening 11 and a click 642. The other end which is combined with the bottom cover 2 and has wire slot 12, copper contact sheet passing hole or electrical contact hole 13, bottom cover insertion hole 14, a ring shaped flange of an outer edge 15 and ring shaped flange of inner edge 16. The bottom cover 2 has a reversed hook formed of a stay 21 and flange 23. One end of copper contact sheet 3 has a taper portion 31 comprising multiple tapers, and the other end has a contact portion formed as an elliptical, rectangular or circular shape. The insulating portion 51 of the wires 5 has multiple copper wire 52. Further, between the insulating body 1 and the lamp bulb 4, a bulb securing means such as a plug configuration 64 is arranged. The plug configuration 64 is formed by two semi-circular shaped plugs 645, which individually have a stay 643 with the reversed hook 644. When the combination is done with the wave shaped extension arm 647 which is at a vertical angle to semi-circular shaped plug 645, the copper contact sheet 3 is past through the insertion hole 13 for copper contact sheet 3 and is fixed in a position. The wire 5 is placed in the wire slot 12, and the taper portion 31 pierces the insulating portion 51 to contact to the copper wire 52. The stay 21 of the bottom cover 2 passes through the bottom cover insertion hole 14, then the reversed hook 22 is tightly fixed on the insulating body 1, the connection of ring shaped flange of outer edge 15 and ring shaped flange of inner edge 16 being done simultaneously. The connection of ring shaped plug 641 is done at the opening 11 of insulating body 1. The click 642 is fixed the stay 643 and fastened tightly in the position with the reversed hook 644. The two wave shaped extension arms 647 are arranged along the inner wall of opening 11. When the lamp bulb 4 locks into the opening 11, the screw shaped bulb head 433 is rotated along the wave shaped extension arm 647, the two poles of the head of lamp bulb and the circular arc portion on the contact portion 32 of the copper contact sheet 3 are contacted to form a complete electric circuit. Further, the ring shaped plug 641 is inserted between the glass housing 41 and the inner wall of opening 11 of the lamp bulb 4, so as to obtain a tight and safe lamp socket unit.

FIGS. 2, 2A and 2B show the structure of the plug configuration of the present invention of lamp socket unit. As the structure shown in FIG. 1, the detailed description is done. The plug configuration 64 is composed of two semi-circular shaped plugs 645 which each have a stay 643 with the reversed hook 644 and wave shaped extension arm 647. Further, two ends of each half circles have a semi-flange 646 on a different side. The combination of two different sides is done to obtain a structure of an expandable and shrinkable plug configuration.

FIGS. 3, 3A and 3B show the combination of the copper contact sheet, wire and insulating body of the present invention of lamp socket unit. The copper contact sheet is formed from the copper sheet. The upper sheet is pressed and transformed into an elliptical shape or rectangular shape, and formed with a longitudinal joint 315 and vertical flange 316. The inner part is hollow. In the two long sides of one end, one forms a taper 311, and the other long side forms two tapers 312, 313 at both sides of the joint 315. The contact portion 32 of the another end has circular arc portion 36. The waist of the contact portion is formed with a side wing 34 and a reversed tip 35. The insulating body 1 is arranged with the insertion hole 13 for the copper contact sheet, and the wire 5 has an insulating portion 51 and copper wire 52. While combining, the contact portion 32 passes through the insertion hole 13 for copper contact sheet, and to be fixed in the position of insulating body 1 with side wing 34 and reversed tip 35 so as to fix the copper sheet at a right or corrected position three tapers also while combining, the 311, 312 and 313 pierces into the insulating portion 51 and contact wire 52, so as to form a structure with a safe and excellent contact.

FIG. 4 includes FIGS. 4A, 4B, 4C and 4D which show the combination of the cross-section of the rectangular shaped copper contact sheet 3 and insulating body 1 of the present invention of lamp socket unit. The copper contact sheet 3 is pressed and transformed to form a rectangular shape 332. A long side of rectangular shape hole 132 has an opening 133 to accept the flange 316 whereby to fix the direction. The other detailed explanations are referring to the descriptions in FIG. 3.

FIG. 5 includes FIGS. 5A, 5B, 5C, 5D and 5E which show the combination of the cross-section of the copper contact sheet with one end of elliptical shape and the another end with circular shape and insulating body of the present invention of lamp socket unit. The copper contact sheet 3 is formed from the copper sheet to be pressed and transformed into one end of elliptical shape 331 and the another end of circular shape 333. The taper 311 of the copper contact sheet forms longitudinal recess slot 314 so that the taper 311 is not easily transfigure and/or bent. The other detailed explanations correspond to the descriptions in FIGS. 3 and 4.

Figure 6C:
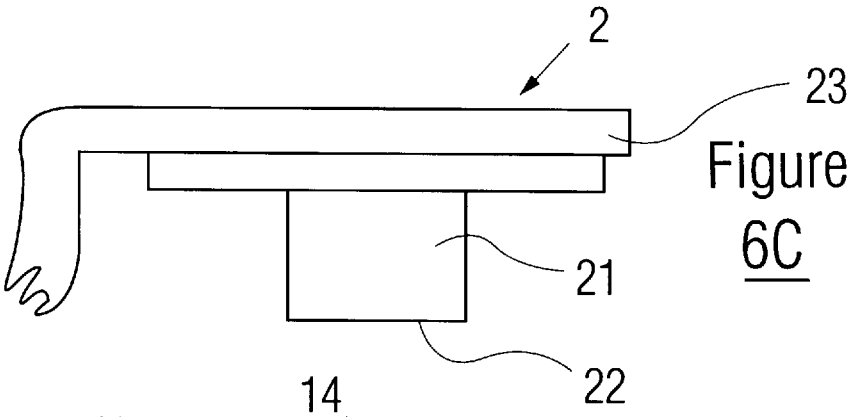
FIG. 6C is the front view of the bottom cover.
Figure 6B:
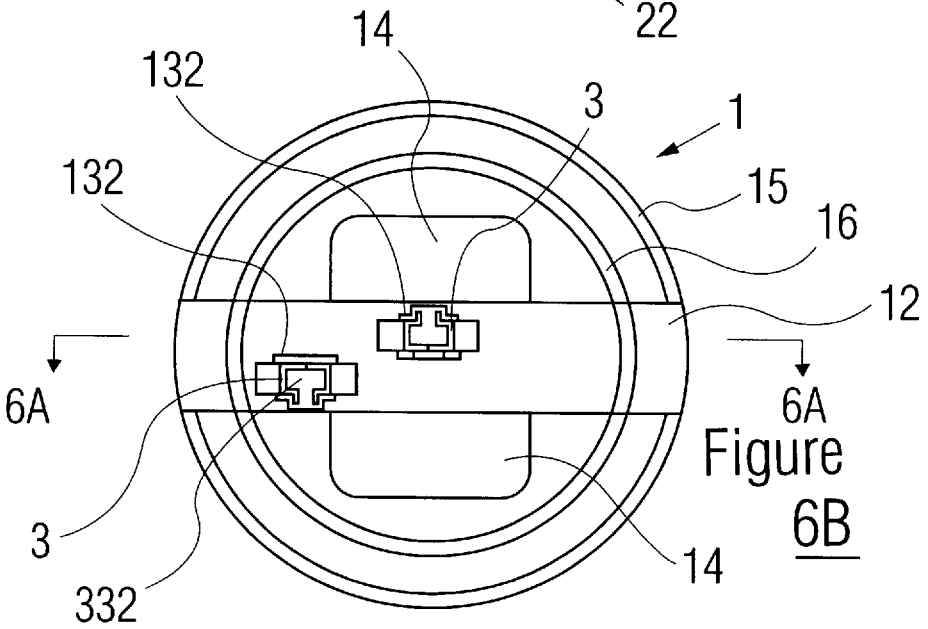
FIG. 6B is the top view.
Figure 6A:
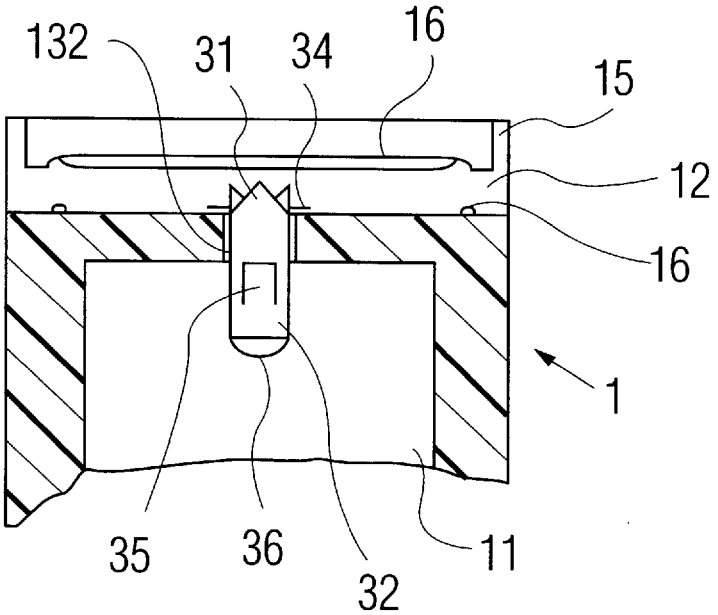
FIG. 6A is the cross-section of line 6A—6A in FIG. 5B.

FIG. 6 includes FIGS. 6A, 6B and 6C which show the structure of the insulating body 1, copper contact sheet 3 and bottom cover 2 of the present invention. The insulating body 1 has an opening 11, wire slot 12, rectangular shaped hole 132, bottom cover insertion hole 14, ring shaped flange of outer edge 15 and ring shaped flange of inner edge 16. The copper contact sheet 3 has a taper portion 31, contact portion 32 and rectangular shaped hole 332. The bottom cover 2 has the stay 21, revered hook 22 and flange 23. These drawings show the combination of them and the relative positions.

Figure 7:
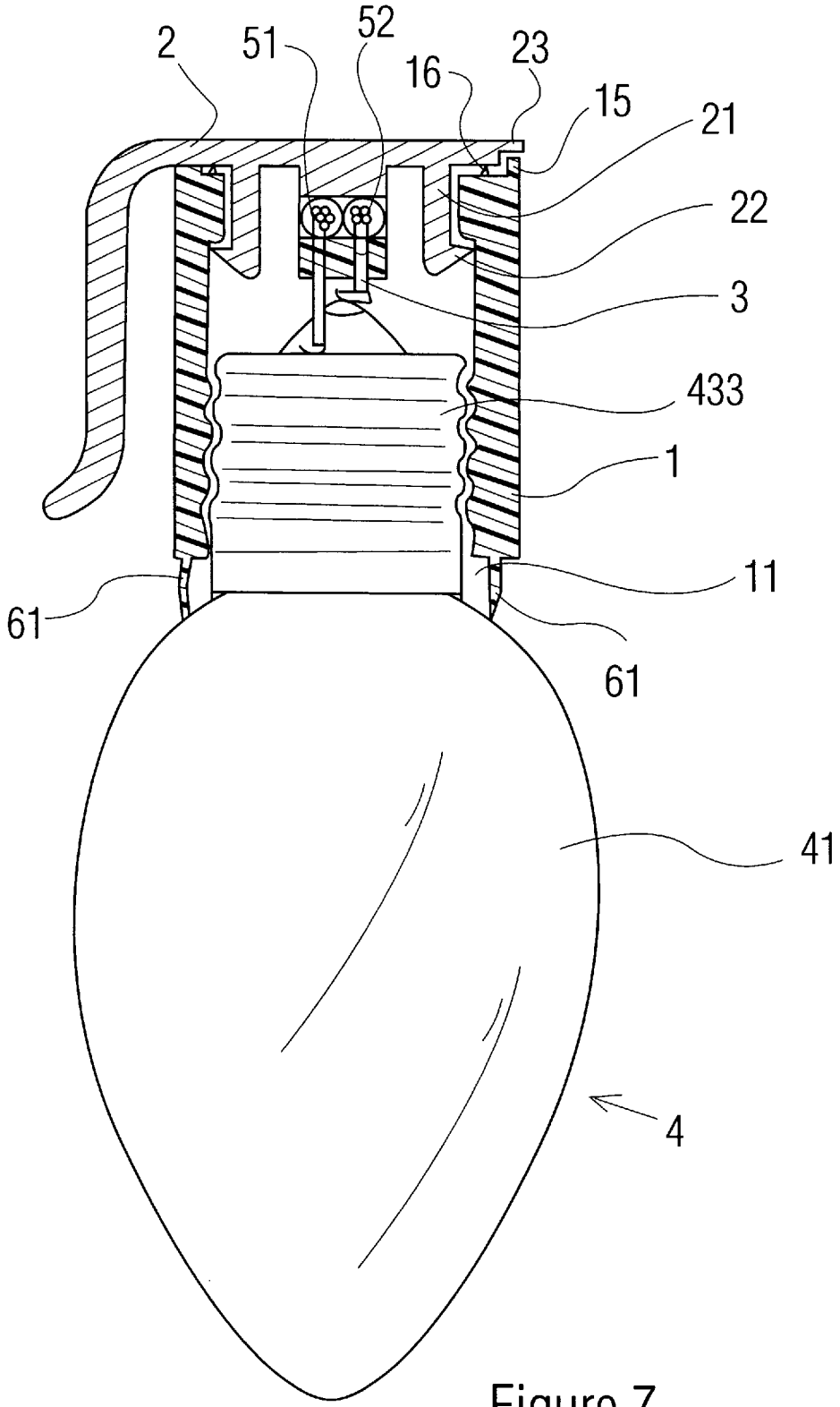
FIG. 7 is the cross-sectional of side view of of the lamp socket unit.

FIG. 7 shows an embodiment of a plug configuration of the present invention. The edge of an opening 11 of the combination portion (terminal) of the insulating body 1 and the lamp bulb 4 has a bulb receiving means formed by an extended and thinner ring shaped flange 61. The other parts of insulating body 1, bottom cover 2, copper contact sheet 3, lamp bulb 4 and wire 5 are identical with those of in FIG. 1. While the combination being done, the screw shaped bulb head 433 of the lamp bulb 4 is screwed up from opening 11 into the right or final position, so that the ring shaped flange 61 and the glass housing 41 are connected tightly to each other, so as to obtain sealing. The other detailed explanations are referring to the descriptions in FIG. 1.

Figure 8:
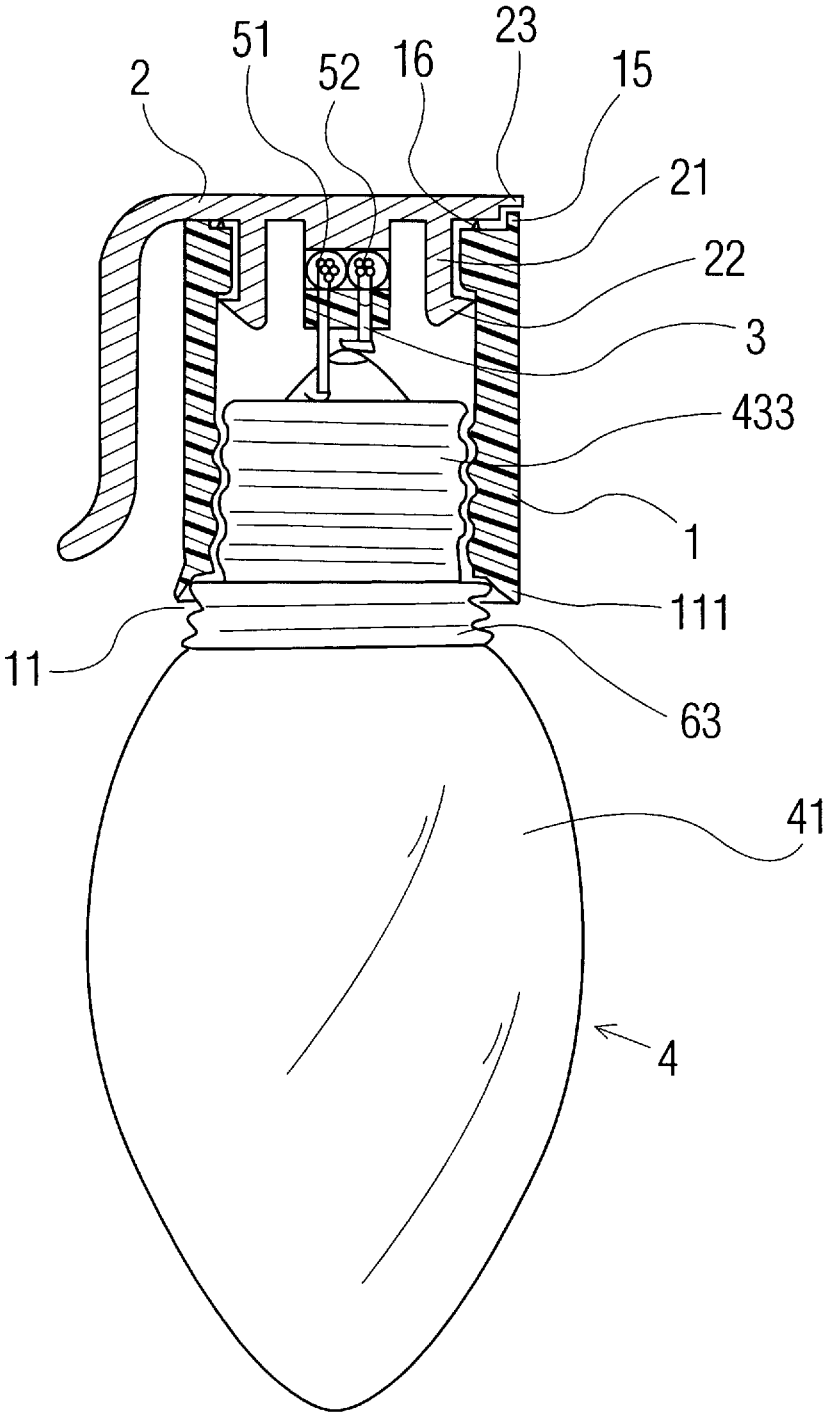
FIG. 8 is a further embodiment of the cross-sectional side view of of the lamp socket unit.

FIG. 8 shows a further embodiment of plug configuration of the present invention. The edge of an opening 11 of the combination portion of the insulating body 1 and the lamp bulb 4 has a bulb securing means formed as an opening outer edge or flange 111. The other parts of insulating body 1, bottom cover 2, copper contact sheet 3, lamp bulb 4 and wire 5 are identical with those of in FIG. 1. When the lamp bulb 4 is screwed into opening 11, the bulb is trapped into the ring shaped expansion tubing 63. When the lamp bulb 4 is screwed into the right position, the ring shaped expansion tubing 63 is pressed between the opening outer edge 111 and glass housing 41 to obtain a tight sealing. The other detailed explanations are referring to the descriptions in FIG. 1.

Figure 9:
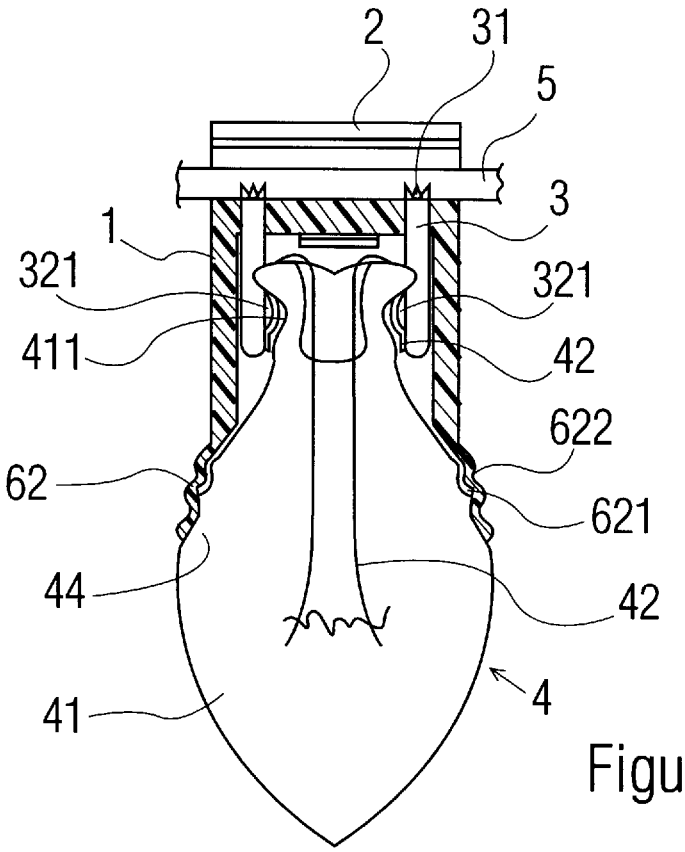
FIG. 9 is a further embodiment of the cross-sectional side view of of the lamp socket unit.

FIG. 9 shows another embodiment of plug configuration of the present invention. The edge of the opening portion of the combination portion of the insulating body 1 and the lamp bulb 4 has a bulb securing means formed as a stepped ring shaped outwardly increasing flange portion 62, the longitudinal ring 621 being much thicker and the transverse ring 622 being much thinner. While the lamp bulb is being assembled, the glass housing of lamp bulb is pressed into the opening or the lamp bulb is pressed outwardly, to make the stepped ring shaped outwardly increasing portion expand or shrink, and thus being connected with the glass housing tightly. The copper contact sheet 3 has a flange 321 and the lamp bulb 4 has transverse ring shaped recess slot 411. Further, the glass housing 41 has stepped portion 44. While the combining is being done,the conducting wire 42 of lamp bulb bends reversibly along the outer wall of glass tightly and is placed in the transverse ring shaped recess slot 411. When the lamp bulb is put into insulating body 1, the transverse ring shaped recess slot 411 and flange 321 are connected tightly and the conducting wire 42 is sandwiched between them. Thus the conducting wire 42 contacts the flange 321 in connection with the copper contact sheet 3 and wire 5 to form an electric circuit. The stepped ring shaped outwardly increasing portion 62 is tightly connected with the stepped portion 44 of the glass housing so as to form an excellent structure with a fixed connection. The other detailed explanations are described in the descriptions of FIGS. 1 and 7.

Figure 10:
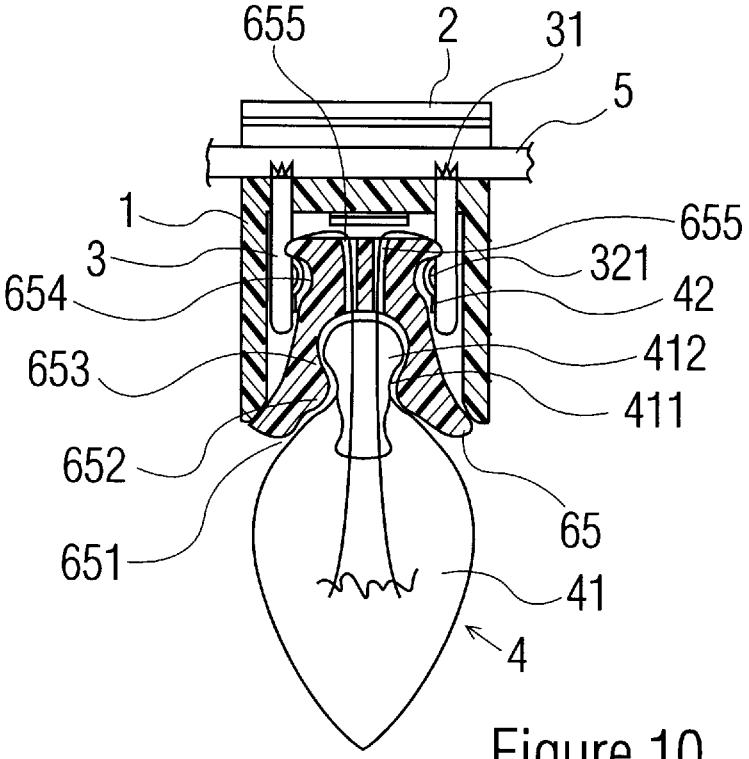
FIG. 10 is a further embodiment of the cross-sectional side view of of the lamp socket unit.

FIG. 10 shows a still further embodiment of a bulb securing means formed in a plug configuration of the present invention. The plug configuration 65 has a circular outward opening 651, a bulb conducting wire insertion hole 655, a inner wall transverse ring shaped flange 652, a inner wall transverse ring shaped recess slot 653 and an outer wall transverse recess slot 654. The copper contact sheet 3 has a flange 321 and the lamp bulb 4 has transverse ring shaped recess slot 411 and transverse ring shaped flange 412. While the combining is being done, the conducting wire 42 passed from circular outward opening 651, through bulb conducting wire insertion hole 655 to extend outwardly, and is then bent reversibly and tightly to connect to the outer wall transverse recess slot 654 of plug configuration 65. A connection is then tightly made of the inner wall transverse ring shaped flange 652 and the transverse ring shaped recess slot 411, and of the inner wall transverse ring shaped recess slot 653 and the transverse ring shaped flange 412, into the opening of insulating body 1 until in the right position. The conducting wire 42 is sandwiched within the outer wall transverse recess slot 654 and flange 321, which is in connection with the copper contact sheet 3 and wire 5 to form an electric circuit. The plug configuration 65 is placed between the insulating body 1 and lamp bulb 4 and these are tightly connected. The other detailed explanations are given in the descriptions of the above mentioned drawings.

Figure 11A:
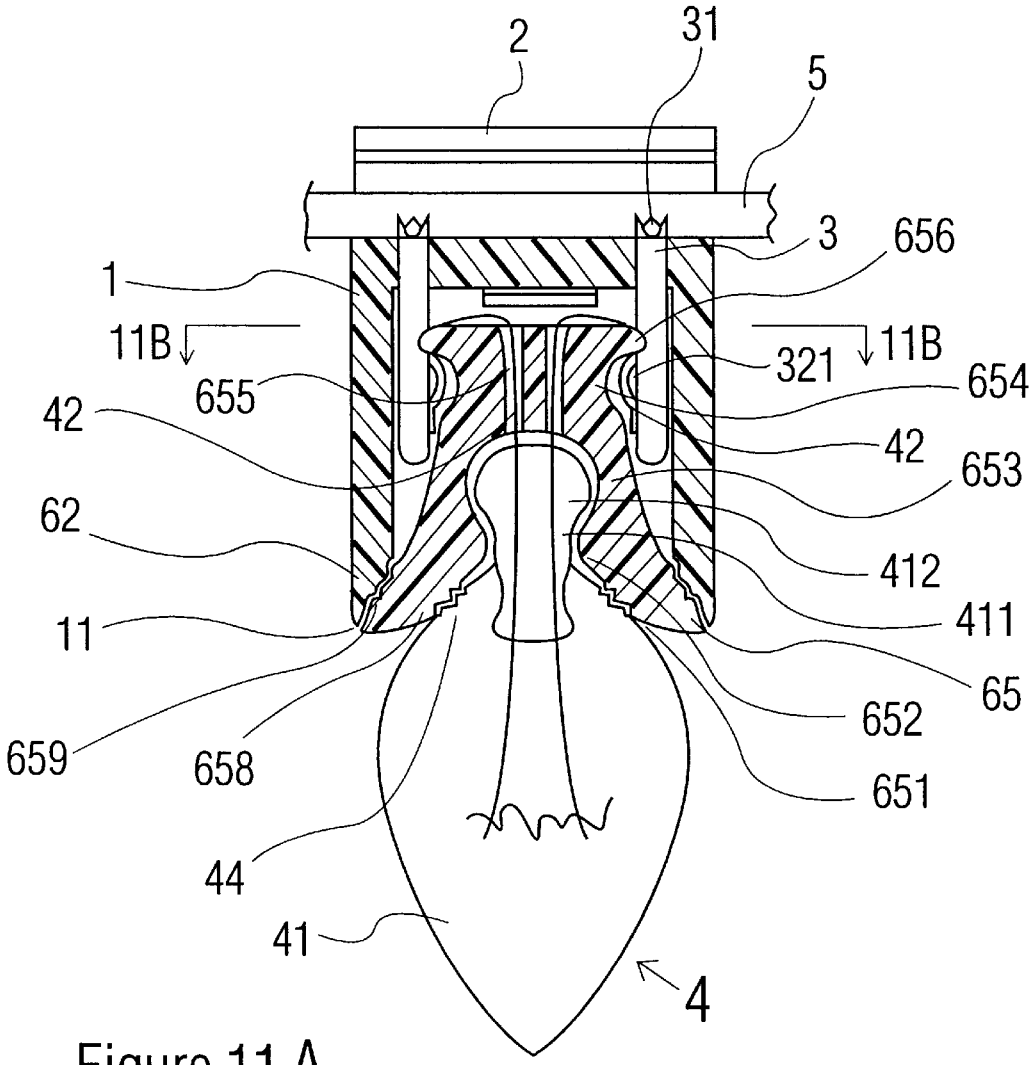
FIG. 11A is the cross-section of line 11A—11A in FIG. 11B.
Figure 11B:
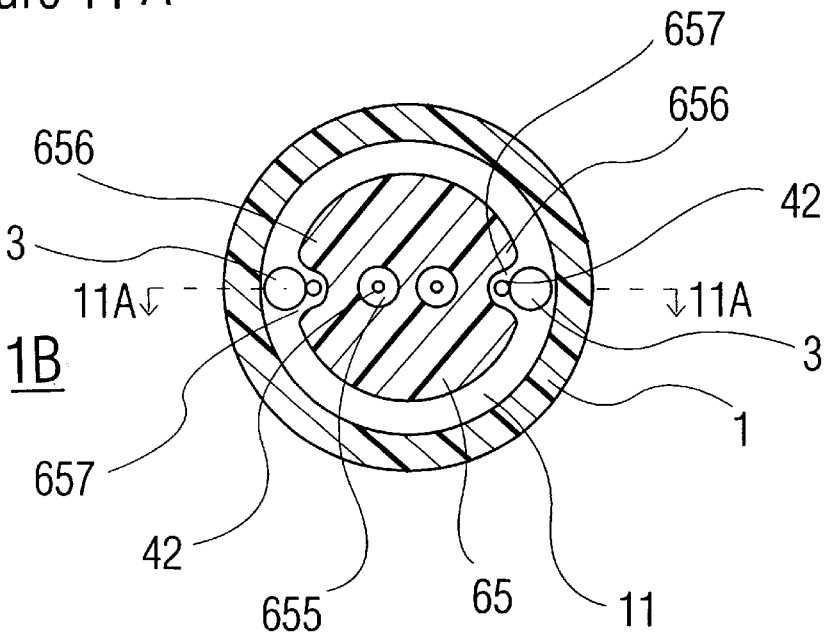
FIG. 11B is the cross-section of line 11A—11A in FIG. 11B line.
Figure 5C:
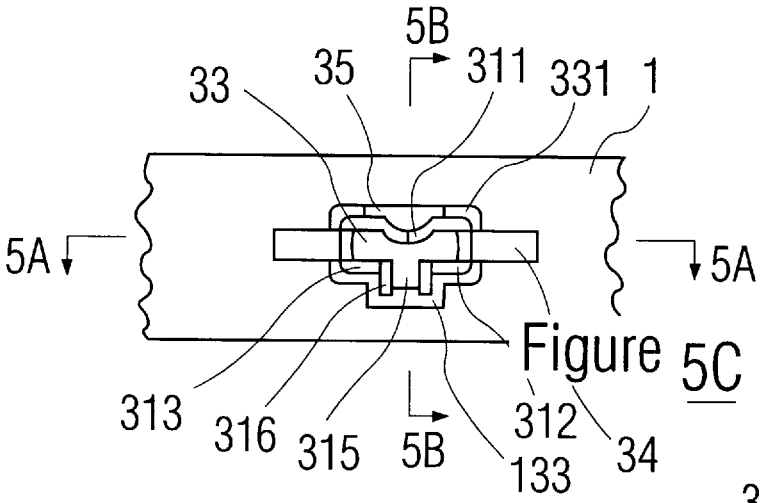
FIG. 5C is the top view.
Figure 5A:
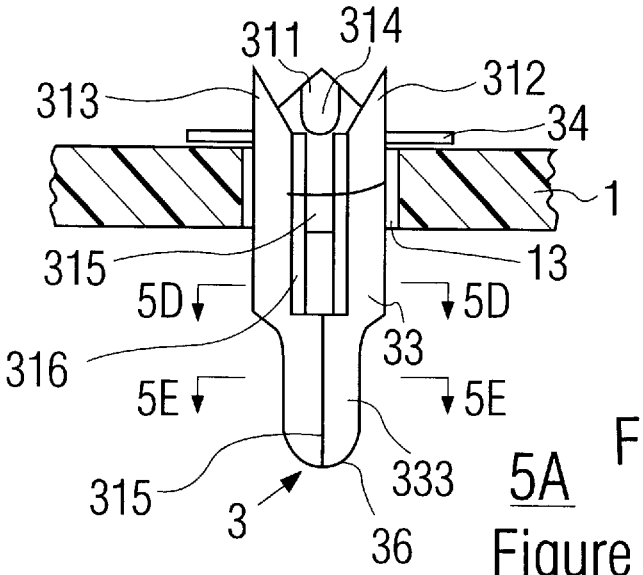
FIG. 5A is the cross-section section of line 5A—5A in FIG. 5C, is the cross-section of line 5B—5B in FIG. 5C.
Figure 5B:
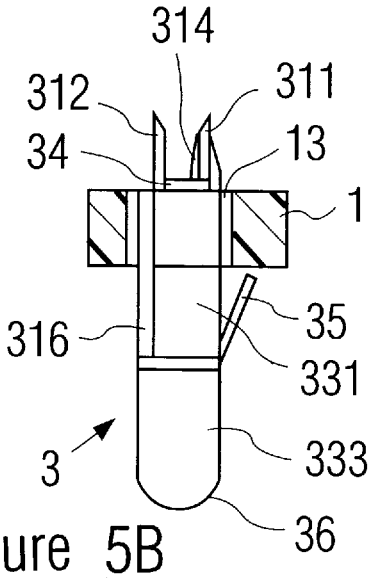
FIG. 5 is a further embodiment of the structure of copper contact sheet and the insulating body of the lamp socket unit.
FIG. 5D is the cross-section of line 5D—5D in FIG. 5A.
FIG. 5E is the cross-section of line 5E—5E in FIG. 5A.
Figure 5D:
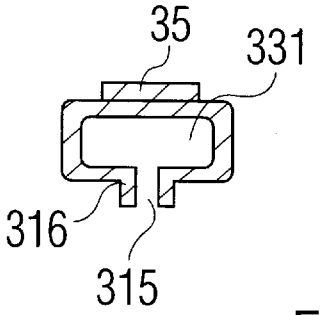
Figure 5E:
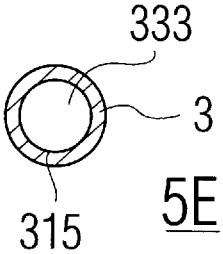

FIG. 11 shows a still further embodiment of a plug configuration of the present invention. The plug configuration 65 has a circular outward opening 651, a bulb conducting wire insertion hole 655, an inner wall transverse ring shaped flange 652, an inner wall transverse ring shaped recess slot 653, an outer wall longitudinal flange 656, an outer wall longitudinal recess slot 657, an inner wall stepped portion 658 and an outer wall stepped portion 659. The copper contact sheet 3 has a flange 321 and the lamp bulb 4 has transverse ring shaped recess slot 411 and transverse ring shaped flange 412. Further, the glass housing 41 has a stepped portion 44 for the glass housing. The opening 11 of the insulating body 1 has stepped ring shaped outwardly increasing portion 62. While combining, the conducting wire 42 is passed from circular outward opening 651 through bulb conducting wire insertion hole 655 to extend outwardly, and then is bent reversibly and tightly to connect the outer wall transverse recess slot 654 of plug configuration 65. A connection is tightly made of the inner wall transverse ring shaped flange 652 and the transverse ring shaped recess slot 411, and of the inner wall transverse ring shaped recess slot 653 and the transverse ring shaped flange 412, into the opening 11 of insulating body 1 until in the right position. The conducting wire 42 is sandwiched between the outer wall transverse recess slot 654 and flange 321, which is in connection with the copper contact sheet 3 and wire 5 to form an electric circuit. The stepped portion 44 of the glass housing and the inner wall stepped portion 658 are connected tightly, and the outer wall stepped portion 659 and stepped ring shaped outwardly increasing portion 62 are also connected tightly. The other detailed explanations are provided in the descriptions of other structures given in the above mentioned drawings.

Although the present invention has been described in terms of particular embodiments, it is not limited to these embodiments. It is possible that alternative embodiments and modifications which would still be encompassed by the present invention may be made by those skilled in the art, particularly in the light of the foregoing teachings. Therefore, it is submitted that the spirit and scope of the present invention should be interpreted and defined by the following claims.

What I claimed is:

1. A lamp socket unit comprising:

an insulating body defining a lamp opening for receiving a lamp bulb, said insulating body also defining a wire slot, said insulating body also defining an electrical contact hole;

electrical contact positioned in said electrical contact hole, said electrical contact having a plurality of taper portions extending into said wire slot, said electrical contact having a contact portion extending into said lamp opening and electrically connectable with the lamp bulb, said electrical contact being formed from a folded rectangular metal sheet, a cross section of said electrical contact and said folded rectangular sheet being one of oval or rectangular shape for strengthening of said electrical contact, said metal sheet forms a joint on a longitudinal side of said electrical contact, said joint of said electrical contact including a flange, wherein said flange is bent around an axis parallel to the longitudinal axis of said contact portion;

a base cover, said insulating body and said base cover having base connection means for connecting said base cover and said insulating body together, and for causing said taper portions to pierce an insulated wire in said wire slot.

2. The lamp socket unit in accordance with claim 1, wherein:

said base cover connection means includes a stay on said base cover with a reversed hook, and includes a cover passing hole defined by said insulating body, said cover passing hole receiving said stay and said reverse hook locking onto said insulating body;

said wire slot receives a plurality of insulated wires;

said insulating body defines a plurality of said electrical contact holes;

a plurality of said electrical contacts are provided, each of said electrical contacts are positioned in one of said electrical contact holes, said each electrical contact has a plurality of taper portions extending into said wire slot and piercing one of said insulating wires to make electrical contact with an electrical conductor in said insulating wires.

3. The lamp socket unit in accordance with claim 1, wherein:

each of two parallel sides of said cross sectional shape form at least one of said tapers.

4. The lamp socket unit in accordance with claim 1, wherein:

a plane of one of said tapers is positioned in parallel with the insulated wire in said wire slot.

5. The lamp socket unit in accordance with claim 1, wherein:

said electrical contact includes a side wing and a reversed tip, said side wing and reverse tip fixing said electrical contact to said insulating body in a specific position.

6. The lamp socket unit in accordance with claim 1, wherein:

at least one of said tapers includes a longitudinal recess slot to strengthen said at least one taper.

7. The lamp socket unit in accordance with claim 1, wherein:

said electrical contact has a cross sectional area adjacent said lamp bulb which is substantially circular.

8. The lamp socket unit in accordance with claim 1, wherein:

an end of said electrical contact adjacent said lamp bulb has a circular arc portion with an outer circumferential surface for contacting said lamp bulb.

9. The lamp socket unit in accordance with claim 1, wherein:

said electrical contact includes a longitudinal flange;

said insertion hole includes a portion for receiving said longitudinal flange of said electrical contact and positioning said electrical contact in a predetermined position.

10. The lamp socket unit in accordance with claim 1, further comprising:

bulb securing means positionable between said lamp opening of said insulating body and said lamp bulb, said bulb securing means holding said lamp bulb steady in said insulating body.

11. The lamp socket unit in accordance with claim 10, wherein:

said lamp bulb includes stepped portions;

said bulb securing means includes stepped portions in contact with said stepped portions of said lamp bulb.

12. The lamp socket unit in accordance with claim 10, wherein:

said bulb securing means is a flange connected to said lamp opening of said insulating body.

13. The lamp socket unit in accordance with claim 1, wherein:

each of two diametrically opposite sides of said cross sectional shape form at least one of said tapers.

14. The lamp socket unit in accordance with claim 10, wherein:

said bulb securing means is a plug insertable into said lamp opening and positioned around said lamp bulb.

15. The lamp socket unit in accordance with claim 14, wherein:

said plug is connected to said lamp opening of said insulating body.

16. The lamp socket unit in accordance with claim 14, wherein:

said lamp opening includes stepped portions;

said plug includes stepped portions in contact with said stepped portions of said lamp opening.

17. The lamp socket unit in accordance with claim 14, wherein:

said lamp bulb defines a recess slot and said lamp bulb includes a ring flange;

said plug defines an inner wall ring shaped recess slot for receiving said ring flange of said lamp bulb, said plug includes an inner wall ring shaped flange insertable into said recess slot of said lamp bulb.

18. The lamp socket unit in accordance with claim 14, wherein:

said plug is connected to said electrical contact.

19. The lamp socket unit in accordance with claim 18, wherein:

said plug defines an outer wall longitudinal slot;

a lamp wire of said lamp bulb is positioned in said outer wall longitudinal slot of said plug said electrical contact is insertable into said outer wall longitudinal slot of said plug and electrically connected to said lamp wire.

20. A lamp socket unit comprising:

an insulating body defining a lamp opening for receiving a lamp bulb, said insulating body also defining a wire slot, said insulating body also defining an electrical contact hole;

electrical contact positioned in said electrical contact hole, said electrical contact having a plurality of taper portions extending into said wire slot, said electrical contact having a contact portion extending into said lamp opening and electrically connectable with the lamp bulb, said electrical contact being formed from a folded rectangular metal sheet, a cross section of said electrical contact and said folded rectangular sheet being one of oval or rectangular shape for strengthening of said electrical contact;

a base cover, said insulating body and said base cover having base connection means for connecting said base cover and said insulating body together, and for causing said taper portions to pierce an insulated wire in said wire slot;

bulb securing means positionable between said lamp opening of said insulating body and said lamp bulb, said bulb securing means holding said lamp bulb steady in said insulating body, said bulb securing means being formed as a plug insertable into said lamp opening and positioned around said lamp bulb.

* * * * *